US005608981A

United States Patent [19]

Canaday

[11] Patent Number: 5,608,981

[45] Date of Patent: Mar. 11, 1997

[54] SINGLE SPRING BOLT LOCK AND CARTRIDGE EJECTOR

[75] Inventor: Michael M. Canaday, King George, Va.

[73] Assignee: The United States of America as represented by the Secretary of the Navy, Washington, D.C.

[21] Appl. No.: 514,576

[22] Filed: Aug. 14, 1995

[51] Int. Cl.[6] ..... F41A 15/16

[52] U.S. Cl. ..... 42/25; 89/138

[58] Field of Search ..... 42/25; 89/138, 89/187.01

[56] References Cited

U.S. PATENT DOCUMENTS

| | | | |
|---|---|---|---|
| 1,041,410 | 10/1912 | Benet et al. | 42/25 |
| 1,335,063 | 3/1920 | Lewis | 42/25 |
| 2,894,346 | 7/1959 | Smith | 42/69 |
| 3,247,610 | 4/1966 | Wallace | 42/25 |
| 4,023,295 | 5/1977 | Hupp et al. | 42/25 |
| 4,438,678 | 3/1984 | Ruger | 89/138 |
| 4,653,210 | 3/1987 | Poff, Jr. | 42/16 |

FOREIGN PATENT DOCUMENTS

| | | | |
|---|---|---|---|
| 618390 | 4/1925 | France | 42/25 |

*Primary Examiner*—Stephen M. Johnson
*Attorney, Agent, or Firm*—James B. Bechtel, Esq.

[57] ABSTRACT

A combination bolt lock and cartridge ejector mechanism for a small arm is provided. The mechanism has a hollow cylindrical bolt lock having slots cut through the cylinder and having beveled shoulder on the bolt engaging end. The cartridge ejector is also slotted and fits inside the hollow bolt lock. A single spring inside the bolt lock operates both the bolt lock and the cartridge ejector. A retaining pin secures the mechanism together and provides a means for attaching the mechanism to a receiver of a small arm.

4 Claims, 6 Drawing Sheets

SINGLE SPRING BOLT LOCK AND CARTRIDGE EJECTOR

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to small arms and in particular to cartridge extraction and bolt locking mechanisms.

BACKGROUND OF THE INVENTION

Gun mechanisms typically have a reciprocating "bolt" or similar part that causes the cartridge to be locked into the chamber of the barrel. Firearms also typically have a cartridge case that serves a dual purpose as a transportation container for the projectile, powder and primer during loading and as a gas seal during firing. Some mechanisms must be provided to cause the case to be removed from the firearm so that the next round can be loaded. This device is the ejector. In self-loading, magazine-fed firearms, it is also desirable that there be a mechanism or device that enables the operator to lock the bolt in the open position so that the firearm may be conveniently loaded.

In both operations, the mechanism should be simple and robust. Typically, in field use of a military firearm, jamming, as a result of moisture and dirt, can be avoided by minimizing the number of moving parts and by employing less complex parts.

SUMMARY OF THE INVENTION

Accordingly, an object of the invention is to provide a combination bolt lock and cartridge ejector.

Another object of the invention is to provide a combination bolt lock and cartridge ejector having reduced lock and ejector movement.

Yet another object of the invention is to provide a combination bolt lock and cartridge ejector having a single operating spring operating both the lock and the ejector.

In accordance with the foregoing and other objects, a combination bolt lock and cartridge ejector for a small firearm having a gas operated bolt is provided. The bolt lock comprises a hollow cylindrical bolt stop having an end section with a cutaway portion. The cutaway provides a flat shoulder surface to block a small arm bolt when the bolt stop is extended into a receiver barrel. The bolt lock encloses a cartridge ejector within the hollow cylinder. The entire mechanism is held together by a single pin which is inserted through slots in both the bolt lock and the cartridge ejector. A single spring which the cylindrical bolt lock exerts a force moving the bolt lock to the unlock position and, on the opposite end of the spring, moving the cartridge ejector toward a bolt for cartridge ejection.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
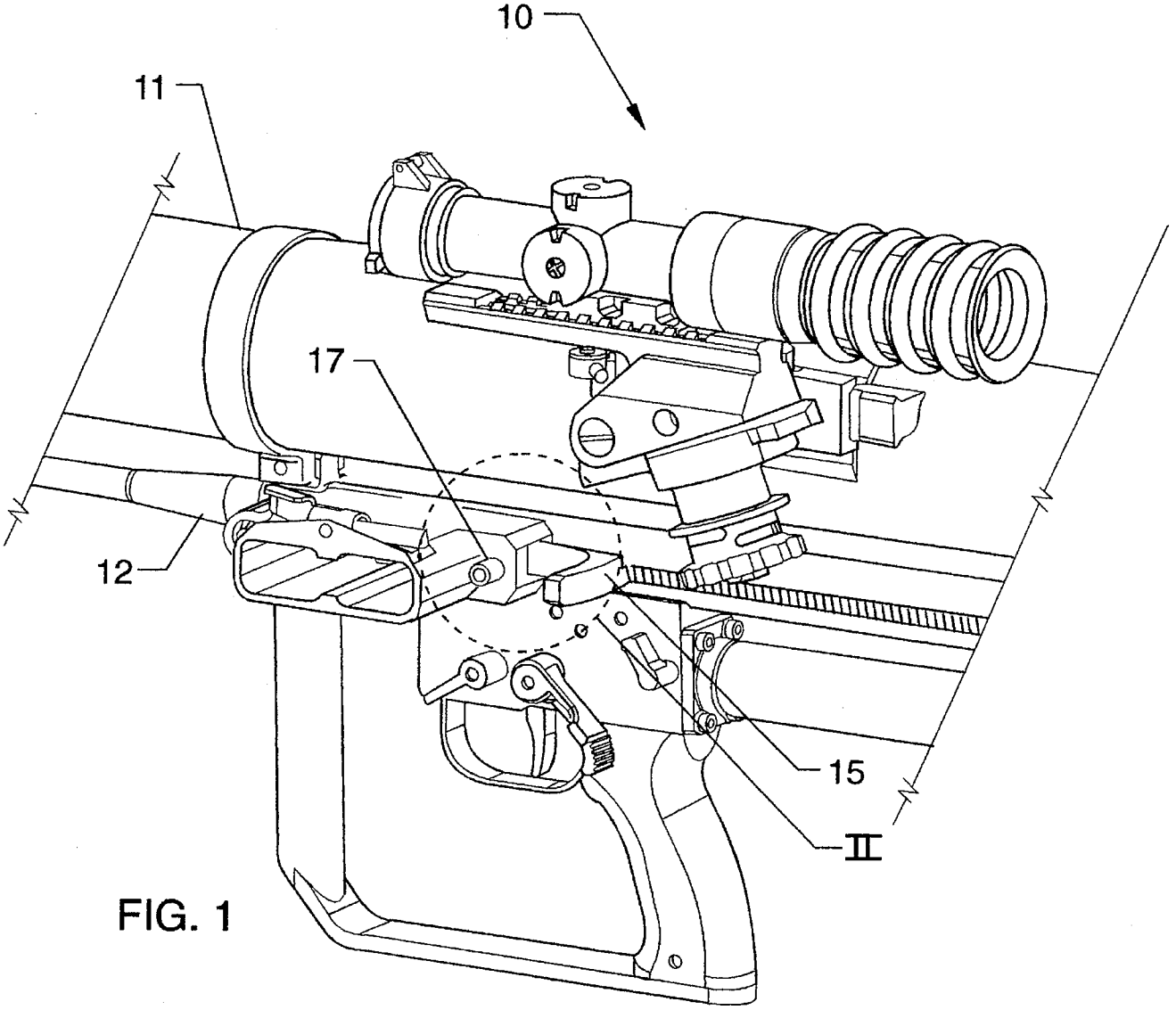
FIG. 1 is a perspective partial view of a shoulder-launched, multiple-purpose assault weapon.

Referring now to FIG. 1, the combination bolt lock and cartridge ejector mechanism 17 is shown mounted on the receiver of a spotter rifle 12 which is attached to a rocket tube 11; however, the mechanism may be adapted to any small firearm. The entire weapon is referenced generally by the numeral 10. Within dotted circle II, the bolt operating handle 15 is shown for reference.

Figure 2:
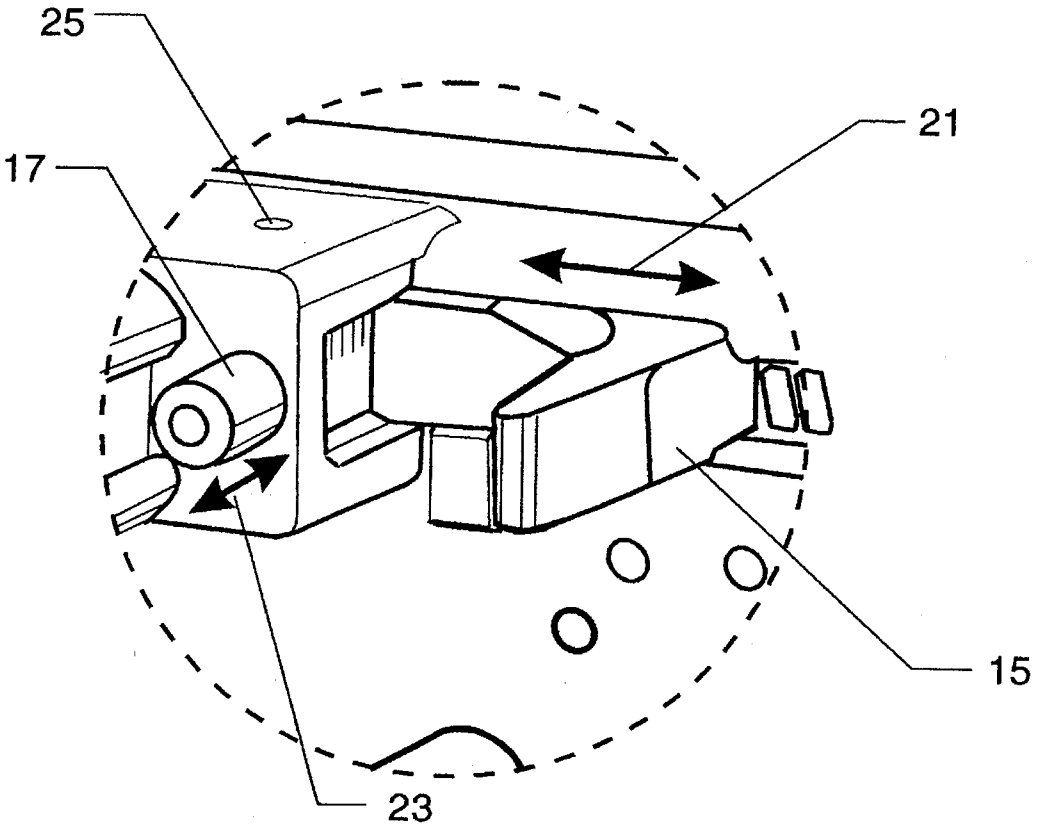
FIG. 2 is an enlarged view of the area of the combination bolt and cartridge ejector designated as dotted circle II in FIG. 1.

The details of the combination bolt lock and cartridge ejector mechanism 17 may be seen in FIG. 2 which is an enlargement of the dotted circle II of FIG. 1. The bolt operates in left and right directions as depicted by arrow 21. The combination bolt lock and cartridge ejector mechanism 17 moves in and out as depicted by arrow 23. When the bolt is drawn back to a rearward position (to the right in the Figure), the combination bolt lock and cartridge ejector mechanism can be depressed by an operator causing the bolt lock to slide in front of the bolt as depicted by arrow 23, thereby locking the bolt open. The entire mechanism is held in place by pin 25.

OPERATION OF THE INVENTION

Figure 3:
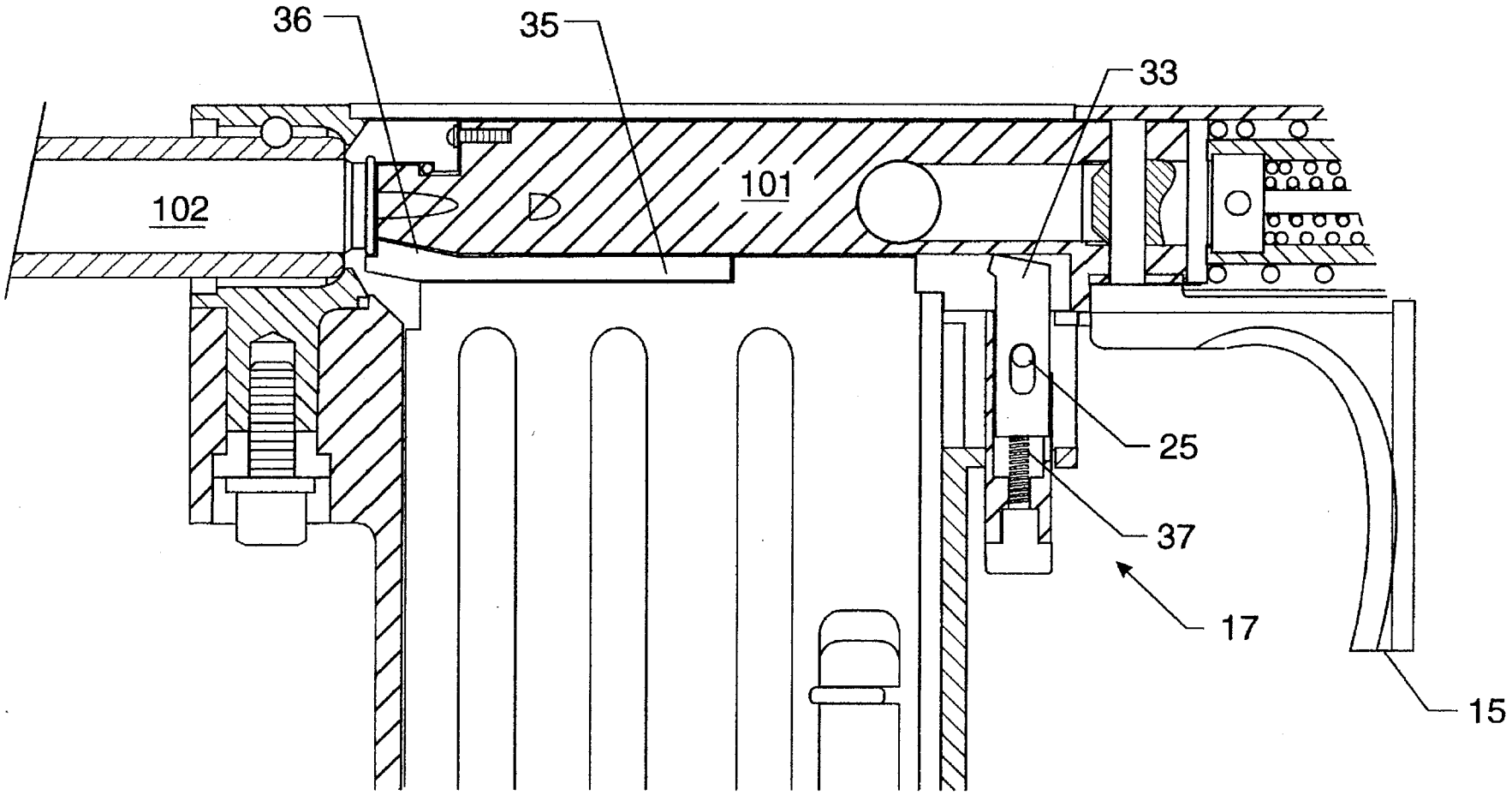
FIG. 3 is a cross-sectional side view of the combination bolt lock and cartridge ejector in the forward position with the shell in the chamber.
Figure 4:
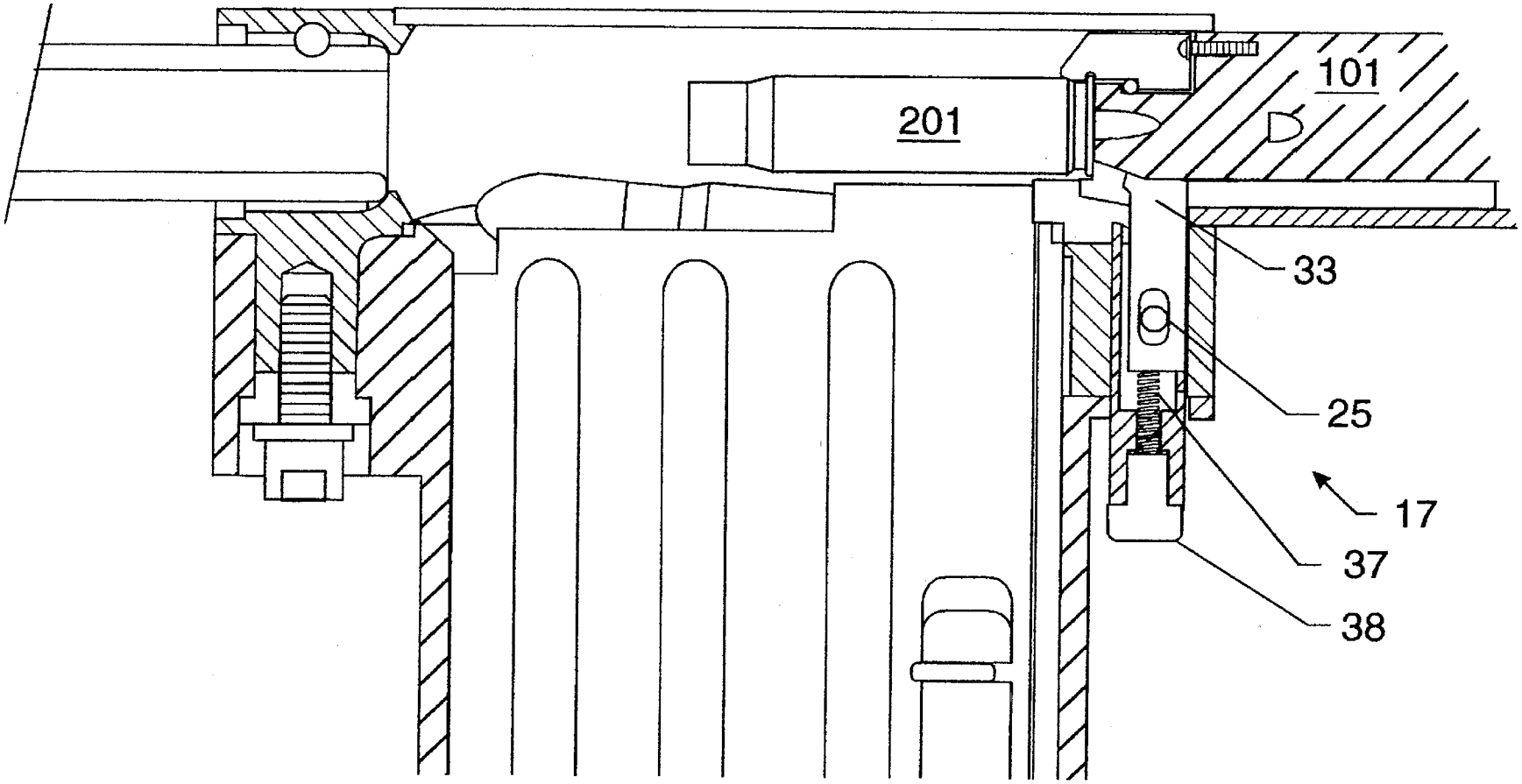
FIG. 4 is a view of the combination bolt lock and cartridge ejector moving to a rearward position and extracting the cartridge.

Referring now to FIG. 3, the operation of the combination bolt lock and cartridge mechanism 17 may be seen in relation to the operating bolt 101. As depicted in this figure, bolt 101 is in the forward position with the cartridge 102 in the firing position. The cartridge ejector 33 with bolt 101 in the forward position, is pushed outward (down in the Figure) away from the centerline of the bolt 101. The cartridge ejector 33 slides along a slot 35 in the bolt 101. As the bolt 101 is retracted, a beveled section 36 of slot 35 allows the ejector 33 to slide inward toward the center of the bolt 101. A single ejector and locking spring insures that the ejector remains snug against the bottom of the slot 35. This action is more clearly depicted in FIG. 4 wherein the bolt 101 is shown nearing the rearward position and ejector 33 is beginning to extend inward to engage the spent cartridge 102. Single ejector and locking spring 37 urges ejector 33 toward the center of bolt 101. The single ejector and locking spring 37 also presses against the bolt lock 38. The bolt lock 38 is a hollow cylindrical tube having a slot on the rearward edge (right hand side) for ejector 33. Although not shown in this cross-sectional view, the bolt lock 38 has an elongated hole for pin 25 identical to the elongated 41 hole shown in the ejector 33.

Figure 5:
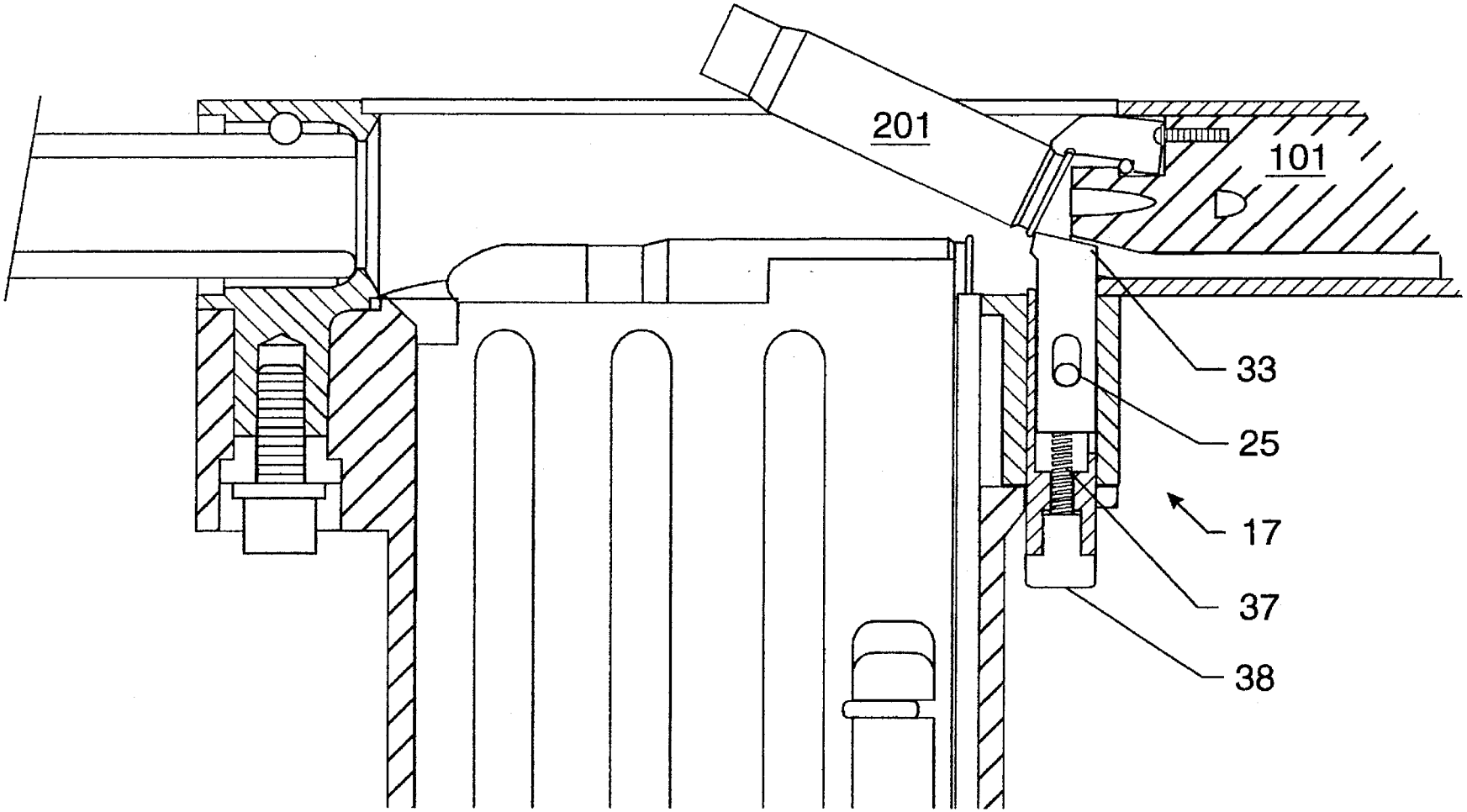
FIG. 5 is a view of the combination bolt lock and cartridge ejector with the spent cartridge ejecting out and a new round entering the chamber.

Referring now to FIG. 5, the spent cartridge 102 is being ejected as shown with the ejector cartridge 33 in the fully extended position. Further extension of the ejector 33 is prevented by the elongated hole 41 located at pin 25. As may be seen in this view, the single spring bolt lock and cartridge ejector spring 37 is in its most extended position.

Figure 6:
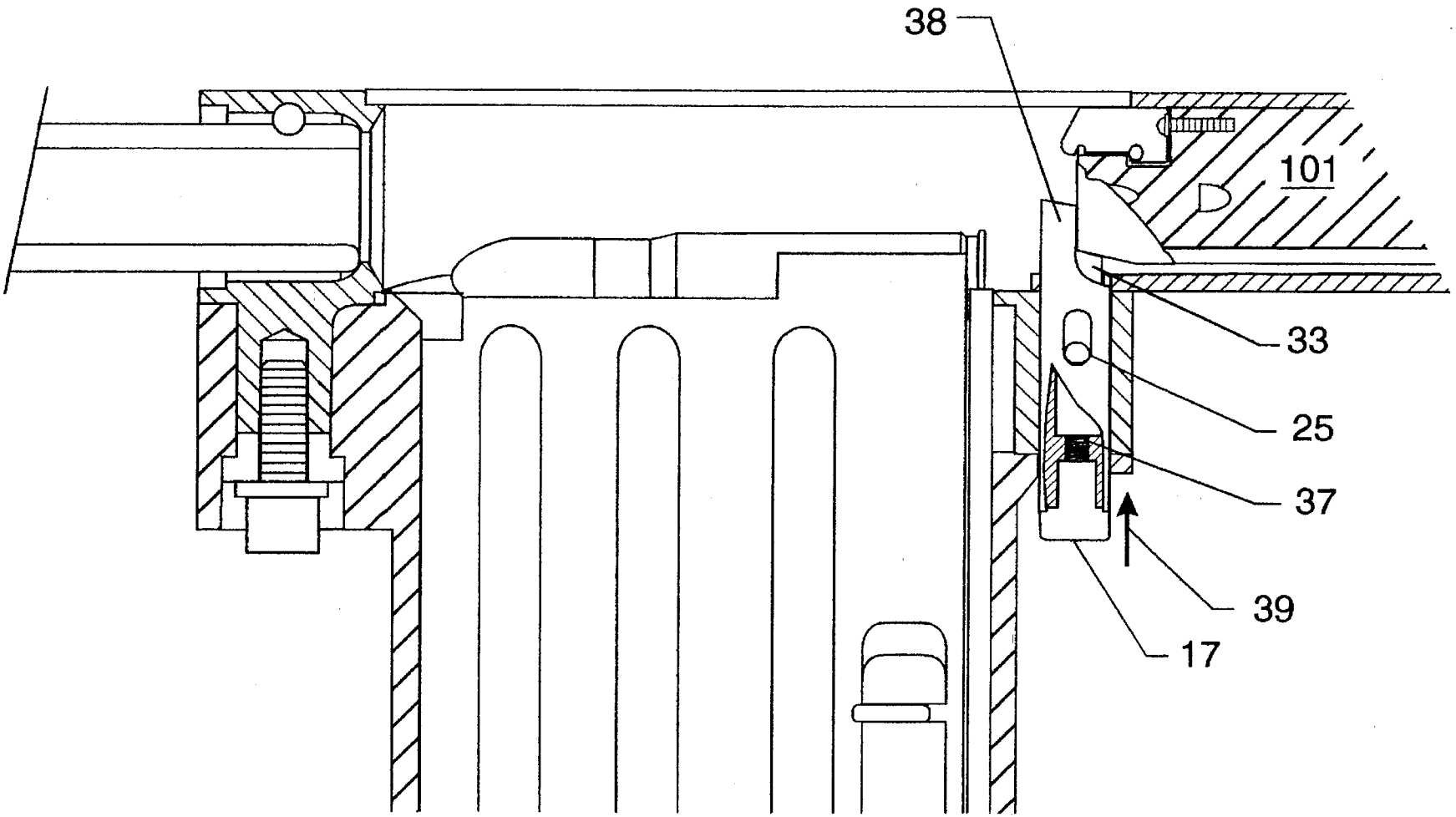
FIG. 6 is a view of the combination bolt lock and cartridge ejector with the bolt locked open.

Referring now to FIG. 6, with the bolt 101 held in the full aft position, the bolt-engaging end of the invention may be engaged by depressing the bolt lock 38 as shown by arrow 39. Moving the bolt lock 38 inward compresses the single spring bolt lock and cartridge ejector spring 37 and moves the lock 38 to the full travel of the elongated hole 61 at pin 25, thereby allowing the beveled shoulders 63 to engage bolt 101 locking the bolt in the rearward position.

The features and advantages of the invention are numerous. The combination bolt lock and cartridge ejector mechanism provides a simple mechanical device which has a high degree of reliability under extreme adverse conditions of dirt, dust, mud and water contamination. The single operating spring performs both the functions of operating the lock and the ejector. The reduced part count increases reliability, decreases weight, and reduces the cost of the weapon.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A combination bolt lock and cartridge ejector mechanism comprising:

a hollow cylindrical bolt lock having an elongated hole for a retaining pin and having beveled shoulders on a bolt-engaging end;

an operating spring inserted inside said hollow cylindrical bolt lock;

a cartridge ejector having an elongated hole and being inserted into said hollow cylindrical bolt lock and thereby compressing said operating spring; and a retainer pin inserted through the elongated holes of both said bolt lock and said cartridge ejector and adapted for attachment to a small arm receiver.

2. A combination bolt lock and cartridge ejector mechanism comprising:

means for locking a bolt in a rearward position;

means for ejecting a cartridge inserted into said means for locking;

a single spring located within said means for locking, said spring operating both said means for locking and said means for ejecting; and a single retaining pin securing said locking and said ejecting means adapted for attachment to a small firearm.

3. A combination bolt lock and cartridge ejector mechanism as in claim 2 wherein said means for locking comprises a hollow cylindrical bolt lock having elongated holes and further having beveled shoulders on a bolt-engaging end.

4. A combination bolt lock and cartridge ejector mechanism as in claim 3 wherein said means for ejecting comprises an ejector having an elongated hole.

* * * * *